US005914735A

United States Patent [19]

Yamamoto et al.

[11] Patent Number: 5,914,735

[45] Date of Patent: Jun. 22, 1999

[54] INK JET RECORDING HEAD RECOVERY MECHANISM WITH REMOVAL OF SOLIDIFIED INK THEREFROM

[75] Inventors: Kosuke Yamamoto, Kawasaki; Hiroshi Sugiyama, Yokohama; Yoshitaka Okamura, Machida, all of Japan

[73] Assignee: Canon Kabushiki Kaisha, Tokyo, Japan

[21] Appl. No.: 08/613,834

[22] Filed: Mar. 11, 1996

Related U.S. Application Data

[63] Continuation of application No. 08/075,837, Jun. 14, 1993, abandoned.

[30] Foreign Application Priority Data

Jun. 12, 1992 [JP] Japan ..... 4-179479

[51] Int. Cl.[6] ..... B41J 2/165; B41J 2/175

[52] U.S. Cl. ..... 347/33; 347/88

[58] Field of Search ..... 347/22, 23, 24, 347/26, 33, 88; 15/250.05, 250.07, 250.09, 250.36, 250.5

[56] References Cited

U.S. PATENT DOCUMENTS

| | | | |
|---|---|---|---|
| 4,065,214 | 12/1977 | Daum et al. | 15/250.06 X |
| 4,745,414 | 5/1988 | Okamura et al. | 347/33 X |
| 4,819,012 | 4/1989 | Kiyohara et al. | 347/30 |
| 4,935,753 | 6/1990 | Lehmann et al. | 347/33 |
| 5,103,244 | 4/1992 | Gast et al. | 347/33 |
| 5,126,765 | 6/1992 | Nakamura | 347/33 |
| 5,182,582 | 1/1993 | Okamura | 347/33 |
| 5,184,147 | 2/1993 | MacLane et al. | 347/33 X |
| 5,202,702 | 4/1993 | Terasawa et al. | 347/33 X |
| 5,270,730 | 12/1993 | Yaegashi et al. | 347/88 X |

FOREIGN PATENT DOCUMENTS

| | | | |
|---|---|---|---|
| 0416849 | 3/1991 | European Pat. Off. . | |
| 0437361 | 7/1991 | European Pat. Off. . | |
| 62-240557 | 10/1987 | Japan . | |
| 62-251145 | 10/1987 | Japan | 347/33 |
| 3-158243 | 7/1991 | Japan | 347/33 |
| 4-141440 | 5/1992 | Japan | 347/33 |
| 4-278358 | 10/1992 | Japan | 347/33 |
| 4-369549 | 12/1992 | Japan | 347/33 |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A recovery mechanism for ink ejection recovery of an ink jet device includes a wiping member for wiping a surface having an ink ejection outlet by relative movement between the wiping member and the surface; and a rubbing member for rubbing the wiping member by relative movement therebetween, the rubbing member being heated at a predetermined temperature.

15 Claims, 6 Drawing Sheets

INK JET RECORDING HEAD RECOVERY MECHANISM WITH REMOVAL OF SOLIDIFIED INK THEREFROM

This application is a continuation of application No. 08/075,837 filed Jun. 14, 1993, now abandoned.

FIELD OF THE INVENTION AND RELATED ART

The present invention relates to a recovery device, an ink jet apparatus having the recovery device and recovery method.

A known recording apparatus having a function of printer, copying machine, facsimile machine or the like, or a known recording apparatus usable as an output device for a combined electronic machine or a work station including a computer and a word processor, is designed such that an image (including characters or the like) is recorded on a recording material in the form of a sheet of paper or in plastic sheet or the like in accordance with image information (character information). Such recording machines are classified, on the basis of the recording systems, into an ink jet type, a wire dot type, a thermal type, a laser beam type or the like.

In a serial type recording apparatus in which the main scan occurs in a direction crossing with the heat material feeding direction (sub-scan direction), the recording material is set at a recording position, and thereafter, the recording material is scanned in the main scan direction by recording means carried on a carriage movable along the recording material. After the recording for one line is completed, the sheet is fed through a predetermined distance, and the sheet is stopped there. Then, the recording for the next line (main scan) is carried out. By repeating these operations, the recording is effected all over the recording material. On the other hand in a line type recording apparatus in which only the sub-scan is effected during the recording operation, the recording material is set at the predetermined recording position, and the recording is effected simultaneously for the one line, and the recording material is continuously fed to effect the record all over the recording material.

In the ink jet type recording apparatus, the ink is ejected onto the recording material from a recording means (recording head) in accordance with image signal. It is advantageous in that the size of the recording means can be reduced, that fine images can be recorded at high speed, that plain paper is usable without special treatment, that the running cost is low, that the noise is small because it is non-impact type, and that it is easy to effect the color image recording with the use of a number of different color inks. Among them, a full-multiple recording means having a great number of ejection outlets arranged in the direction of the width of the sheet, is advantageous because the recording speed can be further increased.

Particularly, an ink jet type recording means (recording head) which ejects the ink using thermal energy can be easily manufactured with high density liquid passages (ejection outlets), since it can be manufactured by etching, evaporation, sputtering or another semiconductor manufacturing process to manufacture electrothermal transducers, electrodes, liquid passages and top plate, the electrothermal transducers and electrodes are formed as films on a substrate. In addition, a high resolution image can be recorded at a high speed with simple and compact structure. On the other hand, various materials for the recording material are desired to be used. Recently, in addition to the usual plain paper or resin thin sheet (OHP sheet or the like), thin sheet of paper or processed sheet (the sheet having perforations for the filing, the sheets with cutting perforations, or non-rectangular sheet), are desired to be used with printers.

In an ink jet recording apparatus, liquid ink is ejected, and therefore, viscosity increase of the ink results from the evaporation of the water content in the ink. When the viscosity increases, the ejection outlet may be clogged with the possible result of improper ejection or ejection failure, and therefore, the image quality is degraded. In order to prevent this inconvenience, the following measurements are taken. Upon the start of the apparatus, the high viscosity ink extends deep into the ejection outlet, and the viscosity of the ink adjacent the ejection outlet is so high that the proper ejection is not possible. Therefore, as a first measure, the viscosity increased ink is forcedly discharged by pressurizing or sucking pump. In the case of on-demand type recording means, there may be such an ejection outlet or outlets as does not eject the ink during the recording operation for a certain period of time. Such an ejection outlet will be completely clogged sooner or later. Therefore, as a second measure, the ink is ejected through all of the ejection outlet (idling or preliminary ejection) irrespective of the image information prior to the certain period elapses, thus preventing the clogging of the ejection outlet. After the first measurement is executed, the ink discharged by the pressurizing or sucking pump, exist adjacent the ejection outlet, and therefore, the desired ejection performance is not maintained with this state. Even if the second measurement is carried out, the mist of the ink is accumulated on the ejection side surface of the recording means after several idle ejecting operations, with the possible result that the ejection outlet is clogged, so that the ejection performance is not as desired. In view of the above, after the above-described measurements are carried out, a cleaning operation for removing the ink deposited adjacent to the ejection outlet, is carried out. The conventional cleaning methods are classified into three types. In the first type, an ink absorbing material such as sponge is contacted to the ejection side surface of the recording means. However, this method involves a problem that with the aging of the sponge, removed small pieces of the sponge or the dried ink deposited on the sponge may enter the ejection outlet with the result of clogging. In a second type, air flow is produced from an air nozzle along the ejection side surface of the recording means, thus blowing the deposited ink out into an ink smup. However, this method involves a problem that it is difficult to completely remove the ink, and that the cost is increased because of the increase of the number of parts including an air pump or an air nozzle. In a third type, the ejection side surface of the recording means or head is rubbed by a wiping member such as rubber blade or the like, thus removing the ink. This method is advantageous in that the ink removing power is high, that the cost is low and that the removing operation is quick, and therefore, this method is widely used. Recently, it has been proposed as one of ink jet recording apparatus that an ink which is solid in the normal temperature, and such ink is liquefied by heating it, and thereafter, it is ejected through an ejection outlet. This is advantageous in that the image can be fixed quickly. In an ink jet recording apparatus using such solid ink, the cleaning operation is required, and the cleaning by the wiping member such as rubber blade or the like is similarly advantageous.

However, in the ink jet recording apparatus of the type in which the solid ink which is liquefied at a temperature higher than the room temperature is liquefied before it is ejected, if the cleaning operation by a wiping member such as rubber blade is carried out, the deposited ink which is still liquid is solidified on a part of the wiping member surface with the decrease of the temperature of the ink. If the cleaning operation is carried out again with this state, the wiping member does not partly in contact with the ejection side surface, so that the cleaning becomes incomplete. In order to prevent this, it would be required that the wiping member such as a rubber blade or the like is heated to a temperature higher than the fusing point of the solid ink. With such heating method, however, the temperature increasing period is long because of the low thermal conductivity of the rubber. The power consumption is also increased.

SUMMARY OF THE INVENTION

Accordingly, it is a principal object of the present invention to provide an ink jet recording apparatus in which the ink deposited on the surface of the wiping member can be easily removed even if the ink which is solidified at a temperature higher than the room temperature is used.

Another object of the present invention is to provide an ink jet recording apparatus in which the ejection side surface of a recording means is cleaned by clean wiping member at all times, thus preventing improper ejection or ejection failure due to incomplete cleaning.

It is a further object of the present invention to provide a recovery device or method with which the ejection side surface of ink jet device can be properly cleaned.

According to an aspect of the present invention, there is provided a recovery mechanism for ink ejection recovery of an ink jet device, comprising: a wiping member for wiping a surface having an ink ejection outlet by relative movement between the wiping member and the surface; and a rubbing member for rubbing the wiping member by relative movement therebetween, the rubbing member being heated at a predetermined temperature.

According to another aspect of the present invention, there is provided an ink jet apparatus, comprising: a recording head having a surface provided with an ink ejection outlet; a wiping member for wiping the surface by relative movement between the wiping member and the surface; a rubbing member for rubbing the wiping member by relative movement therebetween, the rubbing member being heated to a predetermined temperature; temperature control means for controlling the temperature of the rubbing member; and movement control means for controlling movement of the wiping member or the rubbing member.

According to a further aspect of the present invention, there is provided a recovery method for recovering ink ejection of an ink jet device, comprising: wiping a surface of the ink jet device having an ink ejection outlet by relative movement between a wiping member and the surface; and rubbing the wiping member after the wiping step, by relative movement between the wiping member and a rubbing member which is heated to a predetermined temperature.

With such structures, the solidified ink deposited on the wiping member is liquefied and removed by a heated rubbing member, so that the ejection side surface can be always in the cleaned state, that is, with out deposition of the ink. In other words, even if the solid ink is used, the ejection side surface can be completely cleaned with the rubber blade structure without the necessity of heating the wiping member such as rubber blade or the like.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
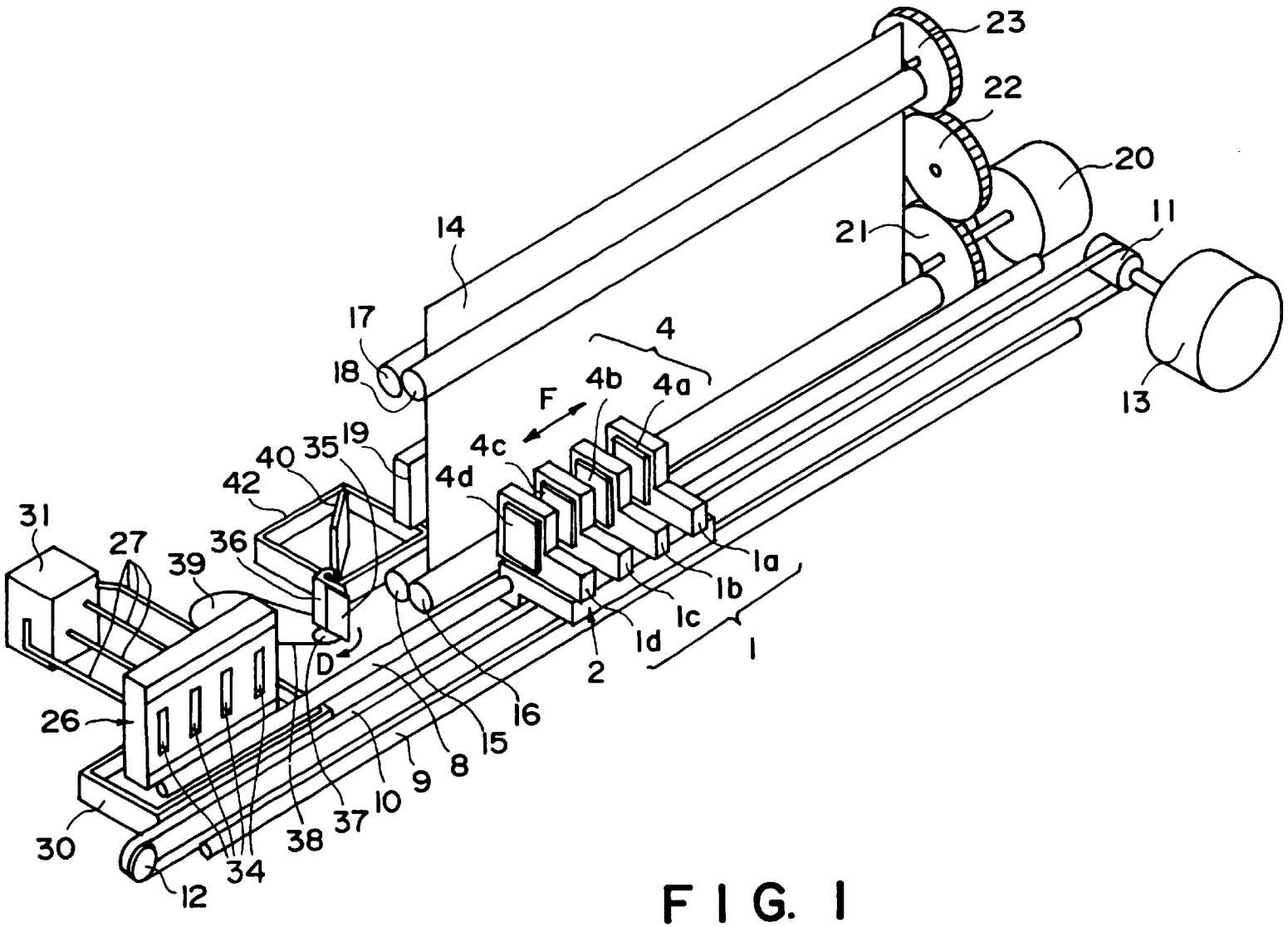
FIG. 1 is a schematic perspective view of an ink jet recording apparatus according to a first embodiment of the present invention.

Referring to the accompanying drawings, the embodiments of the present invention will be described. FIG. 1 is a schematic perspective view of a major part of an ink jet recording apparatus according to a first embodiment of the present invention. In FIG. 1, four recording head (recording means) 1*a*, 1*b*,1*c* and 1*d* are detachably mounted at predetermined intervals on a carriage 2 which is reciprocable along the surface of a recording material 14 in the form of a sheet of paper or plastic film. In the case of color printing, the recording heads contain cyan, magenta, yellow and black inks. In the following description, when any one or all of the recording heads are designated, it or they are called simply recording head 1 or recording means 1.

The carriage 2 is guided and supported on guide rails 8 and 9, and is fixed to a part of an endless belt 10 stretched between a motor pulley 11 and a tension pulley 12. By driving the motor pulley 11 by a carriage motor 13, the carriage 2 is scanningly moved in the main scan direction (F) along the surface of the sheet of the recording material 14. At this time, the clearance between the ejection side surface of the recording head 1 and the recording material 14 surface is approx. 0.5 mm. The supplied recording material 14 is nipped between a feeding roller (sheet feeding roller 15) and a pinch roller (sheet pinching roller) 16. It is fed to a position along the surface of a platen 19, and is nipped between a tension roller 17 and a tension pinching roller 18. Thereafter, the sheet is discharged. The platen 19 is disposed at a position faced to the recording head 1, and at the position of the platen 19, the recording operation is carried out on the recording material 14.

The feeding roller 15 is driven by a feeding roller 20, and the driving force of the feeding motor 20 is also transmitted to the tension roller 17 through a motor gear 21, an idler gear 12 and a tension roller gear 23. The peripheral speed ratio between the feeding roller 15 and the tension roller 17 is approx. 1:1.05 for example. The friction force when nipping the recording material 14 is smaller in the tension roller 17 side than in the feeding roller 15 side, and therefore, the tension roller 17 and the tension pinching roller 18 slide slightly on the recording material 14, and that the recording material 14 is tensioned on the platen 19 to a predetermined degree. By doing so, the contact between the recording material 14 and the recording head 1 is prevented.

The recording head 1 is an ink jet recording means for ejecting the ink using thermal energy, and is provided with an electrothermal transducers for producing thermal energy. The recording head 1 eject the ink using pressure change caused by expansion and collapse of a bubble due to film boiling of the ink caused by the thermal energy applied by the electrothermal transducer. By the ejected ink, the recording is effected.

Figure 2:
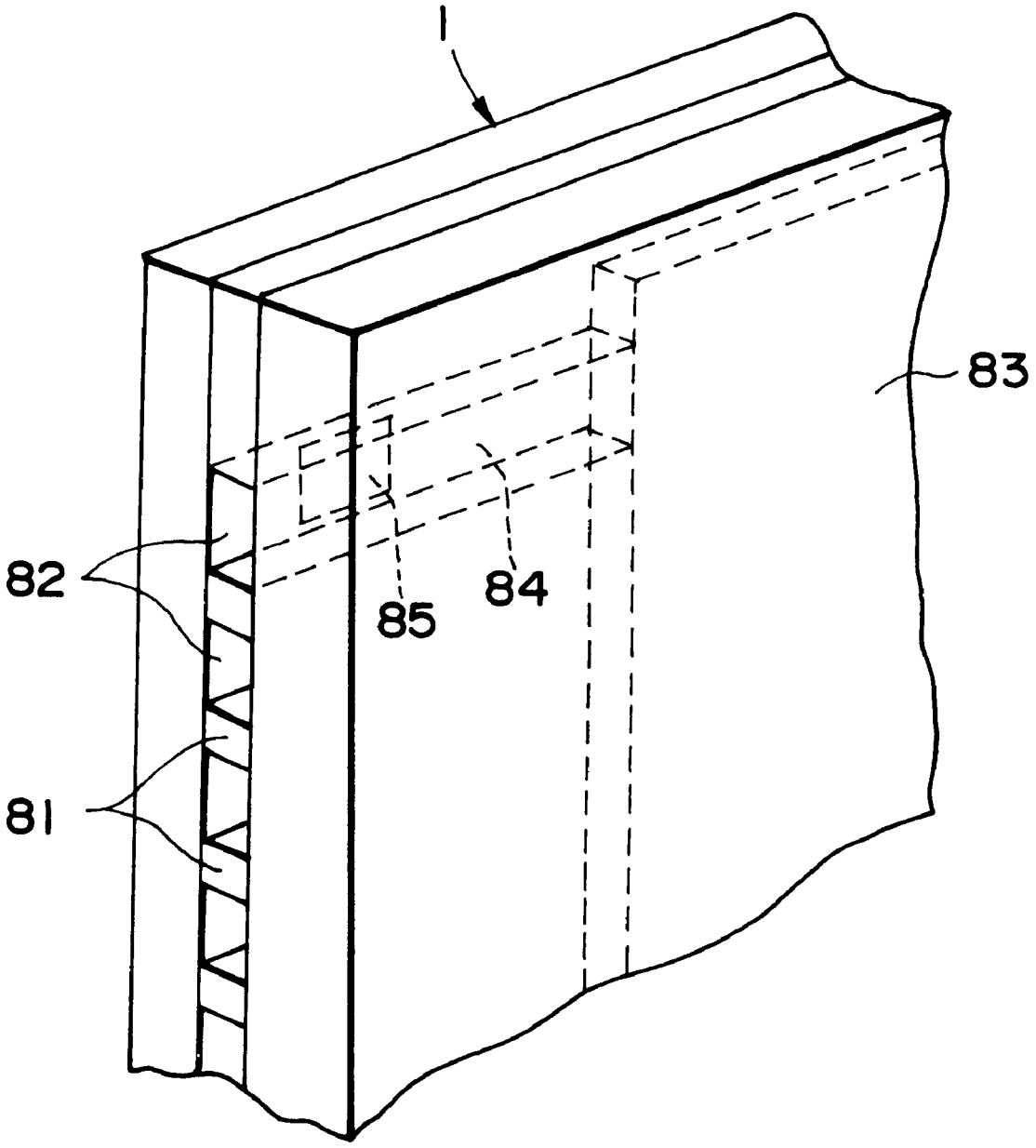
FIG. 2 is a partial perspective view of an ink jet ejecting portion of recording means of the apparatus of FIG. 1.

FIG. 2 is a perspective view of an ink ejection outlet of the recording head 1. The surface having the ejection outlet 82 is faced to the recording material 14 with a predetermined clearance (approx. 0.5–2.0 mm, for example) therebetween. The surface 81 is provided with a plurality of ejection outlets 82 arranged at a predetermined pitch. On a wall of each of liquid passages 84 for communicating a common liquid chamber 83 and the respective ejection outlets 82, an electrothermal transducer (heat generating resistor, for example) 85 for producing the ink ejection energy is mounted. The recording head 1 is carried on the carriage 2 so that the ejection outlets 82 are arranged in a direction crossing with the movement direction (main scan direction) of the carriage 2. The electrothermal transducers 85 are driven or energized in accordance with image signal or ejection signal, by which the ink in the passage 84 is film-boiled, and the ink is ejected through the ejection outlet 82 by the pressure produced thereby, in the recording mechanism (recording head) 1.

In FIG. 1, at a position outside the platen 19 and outside the recording region, there is disposed a cap 26 for hermetically capping the ejection outlets 82 of the recording head when the recording operation is not carried out. The cap 26 defines four spaces 34 corresponding to the respective recording heads (four recording heads in the illustrated example). The spaces 34 are in communication with an air pump 31 through air tubes 27. Below the cap 26, there is a first discharged ink container 30 for receiving the discharged ink.

Between the cap 26 and the platen 19, a rubber blade (wiping member) 35 is disposed to clean (wiping) the ejection side surface of the recording head 1. The rubber blade is mounted on a holder 36 which is rotatably in a direction indicated by an arrow D. Adjacent the rubber blade 35, there is a projection (projected member) 40 for wiping a free end portion of the rubber blade 35.

Figure 3:
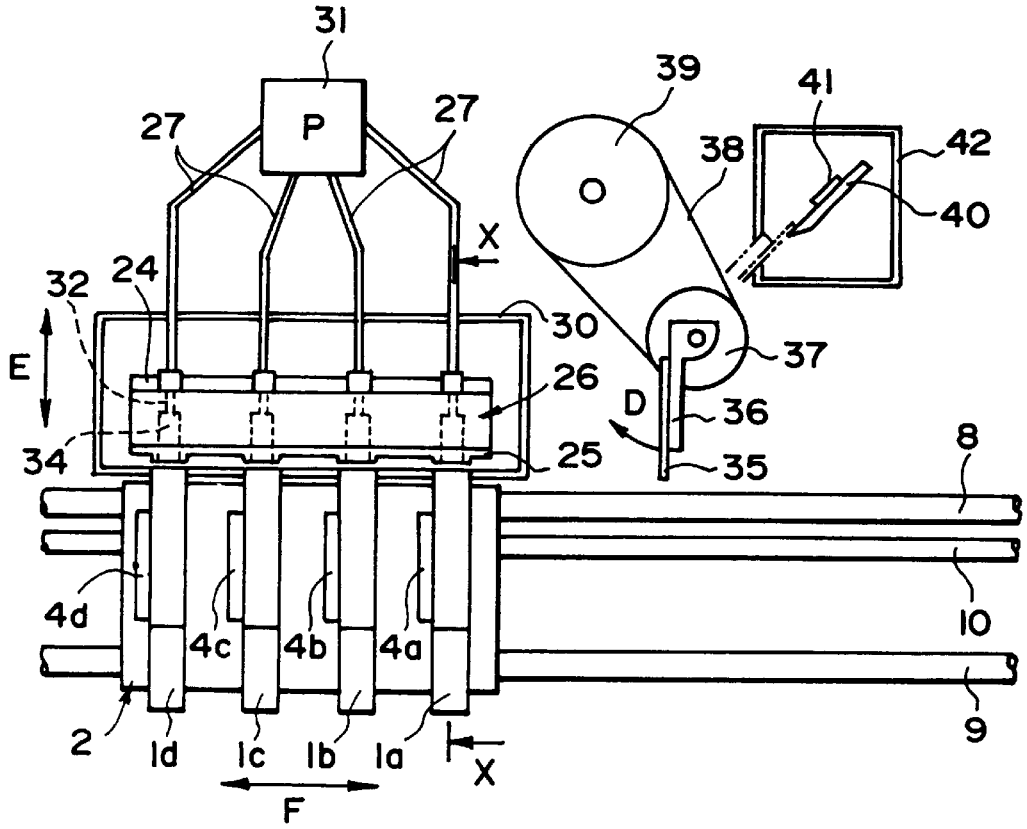
FIG. 3 is a partial plan view of a major part of an ink jet recording apparatus of the first embodiment.

FIG. 3 is a partial plan view of the wiping member 35 in the ink jet recording apparatus of FIG. 1 when the recording head 1 is capped with the cap 26.

Figure 4:
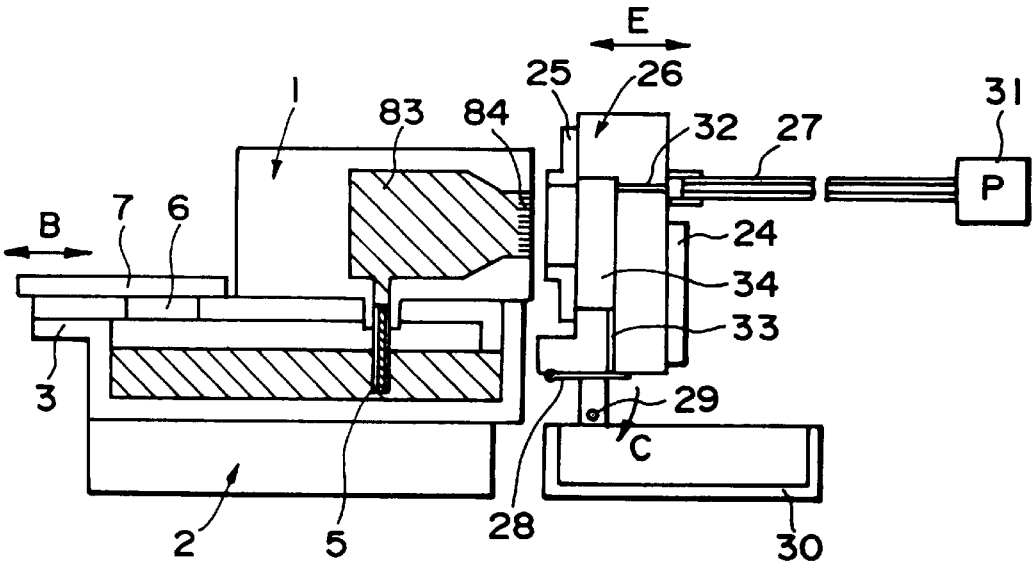
FIG. 4 is a sectional view along a line x—x in FIG. 3.

FIG. 4 is a sectional view taken along a line x—x in FIG. 3. In FIGS. 1–4, the ejection side surface 81 of the recording head 1 has 128 ejection outlets 82 arranged at intervals of 16 outlets per mm, for example. By driving (electric power supply) the electrothermal transducers 85 in the ejection outlets 82 in response to image signals, the ink is ejected through proper ejection outlets 82 to record an image on the recording material 14. As shown in FIG. 4, the recording head 1 is integral with an ink container 3 containing solid ink.

As shown in FIGS. 1 and 3, the recording heads 1*a,* 1*b,* 1*c* and 1*d* are provided with heaters 4*a,* 4*b,* 4*c* and 4*d,* respectively, for the purpose of temperature control of the heads. In the following descriptions, when any one or hole of the head temperature controlling heaters 4*a,* 4*b,* 4*c* and 4*d,* it or they are simply called head temperature control heater 4. In FIG. 4, the fusing point of the solid ink in the ink container 3 is approx. 75° C., for example, and the solid ink is fused or liquefied by the head temperature controlling heater 4, and is supplied into a common liquid chamber 83 of the recording head 1 through an ink supply pipe 5. Further, it is supplied into the liquid passage 84 connected with associated ejection outlet 82. The ink in the liquid passage 84 and the common chamber 83 is maintained in the liquid state by the head temperature controlling heater 4. Above the ink container 3, there is provided an ink supply port 6 and a cover 7 for hermetically closing it. When insufficiency of the ink is detected by ink amount sensor not shown, the cover is slid in the direction indicated by an arrow B to open the supply port 6, thus permitting supply of the ink through the supply port 6.

In FIGS. 3 and 4, the entirety of the cap 26 is maintained at 80° C. for example, by the heater 24. The surface of the cap 26 as is faced to the recording head 1 is provided with a capping rubber (sealing member) 25 for hermetically sealing the ejection outlet 82 when it is contacted to the ejection side surface 81 of the recording head 1. By movement in the direction indicated by an arrow E, the cap 26 is engageable to and disengageable from the ejection side surface 81 of the recording head 1. The spaces 34 of the cap 26 is in communication with the common air pump 31 through air ports 32 and air tubes 27.

Below the cap 26, a discharge ink port 33 communicating with the spaces 34, is formed, and the outlet part of the discharge ink port 28 is provided with a valve 28. The valve 28 is rotatable in a direction C in FIG. 4. Normally, it is at an open position where it is in contact with a stopper 29 by the weight thereof, and is at 45 degrees position from the horizontal line. The residual ink through the ink port 33 is discharged into the first discharge ink container 30.

In FIGS. 1 and 3, the holder 36 having the wiping member (blade rubber) 35 mounted thereto is driven by an unshown motor through a pulley 39, wire 38 and a small pulley 37. The projection (projected member) 40 for wiping the end portion of the wiping member 35 is maintained at a temperature of approx. 80° C. by a heater 41. Below the projection 40, there is disposed a second residual ink container 42 for receiving the ink removed from the wiping member 35.

Figure 5:
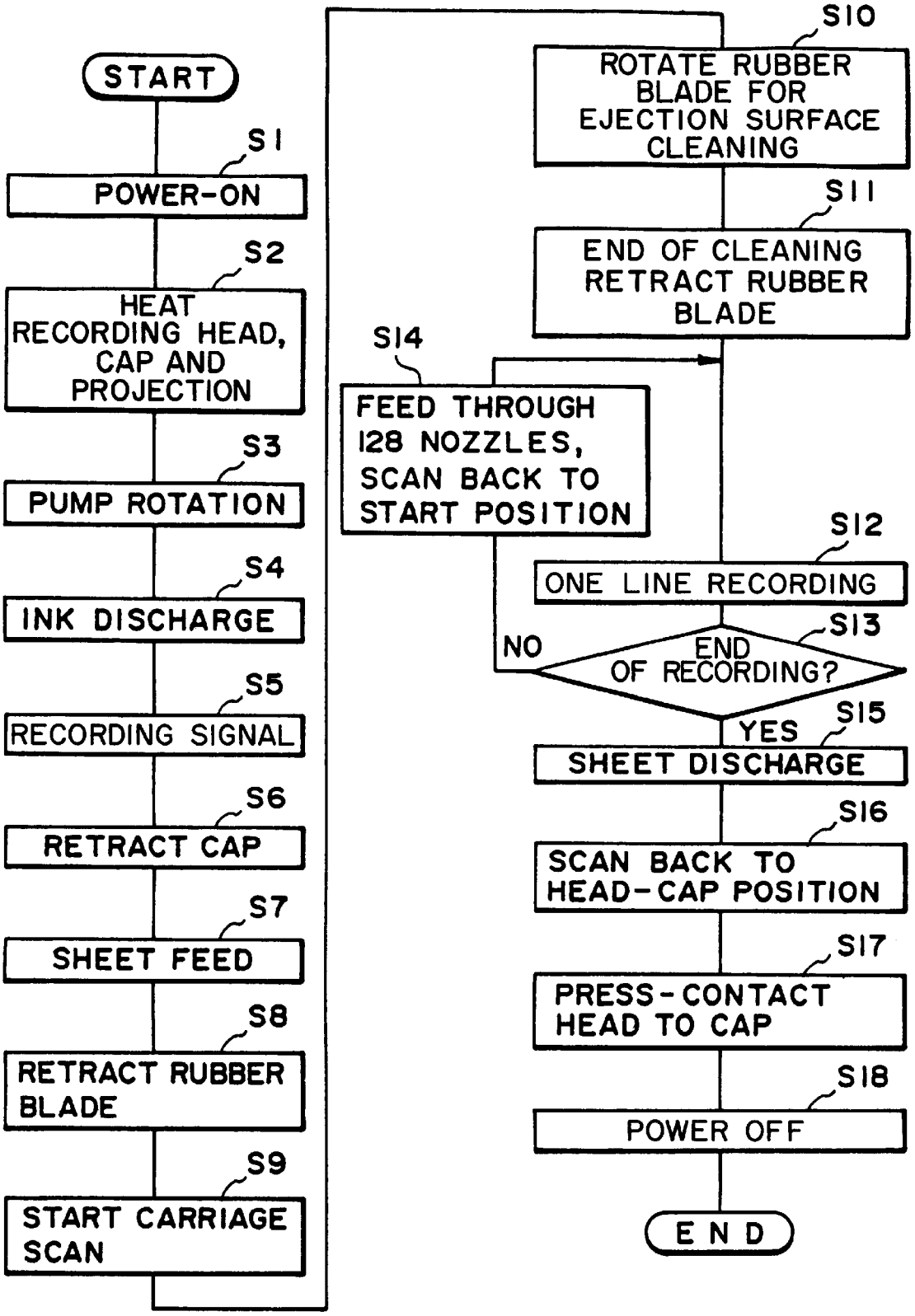
FIG. 5 is a flow chart of sequential operations of the ink jet recording apparatus of the first embodiment.

FIG. 5 is a flow chart illustrating the sequential operations of the ink jet recording apparatus described above. Referring to FIGS. 1–5, the operation of the ink jet recording apparatus will be described. When the main switch (S1) of the recording apparatus is actuated, the temperatures are increased (S2) until the temperature of the recording head 1 reaches 90° C.; the temperature of the cap 26 reaches 80° C.; and the temperature of the projection 40 reaches 80° C. The temperatures are detected by unshown sensors. At this time, the carriage 2 is at the home position, and the cap 26 seals the ejection outlets 82 by contacting to the recording head 1. When the above-described predetermined temperature are reached, the valve 28 is closed, and the pump 31 is driven for a predetermined period of time (S3). By doing so, vacuum is produced in the spaces 34 of the cap 26, so that the liquefied ink in the ink container 3 is sucked into the common liquid chamber 83 through the ink supply pipe 5.

When the liquefied ink is supplied into the common chamber 83, a small quantity of the ink is sucked out through the ejection outlets 82, and the ink is received at the bottom portion of the spaces 34 through the cap rubber 25. After the pump 31 is stopped, the valve 28 is opened, so that the ink in the spaces 34 is discharged into the first residual ink container 30 (S4). Subsequently, a recording signal is supplied (S5), and then, the cap 26 is spaced apart from the recording head 1 (S6), and the carriage 2 is moved toward the right (arrow F) in FIG. 3 (S9). The wiping member 39 is placed at a position indicated in FIG. 3 (S8). At the instance when the ejection side surface 81 of the first recording head 1*a* is contacted thereto, the wiping member 35 starts to rotate in the direction D (S10). By the rotation of the wiping member 35, the ejection side surface 81 of the recording head 1*a* is cleaned (wiped). The rotational speed of the wiping member 35 and this time is set such that when it returns to FIG. 3 position after one full rotation, the right hand end of the ejection side surface 85 of the (second) recording head 1*b* reaches thereto. By the next one turn of the wiping member 35, the ejection side surface 81 of the second recording head 1*b* is cleaned. Similarly, the ejection side surfaces 81 of the recording heads 1*c* and 1*d* are rubbed or wiped by the wiping member 35, so that they are cleaned.

The wiping member (rubber blade) 35 is contacted after the cleaning to the projected member 40, after each cleaning operations for the recording heads, that is, for each one rotation. By doing so, the ink which is going-to be solidified on the free end portion of the wiping member 35 is assured to be in the liquid state by the thermal energy from the projected member 40, for each rotation. In this manner, the ejection side surface 81 can be wiped by the wiping member 35 which is free from the ink. Therefore, the cleaning is assured without the possibility of the mixture of different color inks on the ejection side surface 81. The wiping member 35 after cleaning the recording head 1 (S11), is stopped at a position which is 270 degrees away from the FIG. 3 position in the direction D.

After the completion of the cleaning operation, the recording head 1 is moved into the recording region, thus starting the recording operation. On the other hand, the recording material 14 is retained on the platen 19 with a predetermined tension force applied thereto. After the recording head 1 completes one line recording (S12), the feeding roller 15 and the tension roller 17 are rotated through predetermined degree to feed the recording material 14 upwardly by one line (the distance corresponding to 128 ejection outlets, that is, 8 mm in this embodiment). The recording head 1 returns to a lateral end of the recording material 14 (S14), and the next line recording operation is carried out. In the similar manner, the movement of the recording head (main scan direction) and the feeding of the recording material 14 (sub-scan direction), are alternately repeated to effect the recording operation on the entire surface of the recording material 14. After the recording operation, the recording material 14 is discharged (S15).

In order to prevent the clogging of the ejection outlets 82 which are not used during the recording operation, due to the dried ink, the recording head 1 is returned to a position (home position, for example) where it is faced to the cap 26 (S16) at regular intervals (after each three line recording, for example), and the ink is ejected through all of the ejection outlets 82 a predetermined number of times (50 idle ejections, for example). At the time of the idle ejection, the wiping member 35 is rotated to the cleaning position shown in FIG. 3, and also after the completion of the idling ejection, ejection side surfaces 81 of the recording head 1 are cleaned (wiped). By-doing so, the possible improper ejection attributable to the accumulated ink mist on the ejection side surface 81, can be prevented. After the completion of the recording operation, the recording head at the home position is capped (S17).

According to this embodiment described above, for each cleaning operation for the ejection side surface 81, the relative movement is imparted while the wiping member 35 is in contact with the projection 40 having a temperature not less than the solid ink fusing point, the ink deposited on the surface of the wiping member 35 can be easily and completely removed while maintaining the liquid state of the ink, even in an ink jet apparatus in which a solid ink which is liquefied at a temperature higher than the room temperature is used, and is liquefied and ejected by a recording head 1, and a wiping member 35 is provided to clean the ejection side surface 81 of the recording head 1. Therefore, it becomes possible to clean the ejection side surface 81 of the recording head by a wiping member which is always free from the ink, and therefore, the improper ejection including ejection failure attributable to the incomplete cleaning, can be assuredly avoided.

Figure 6:
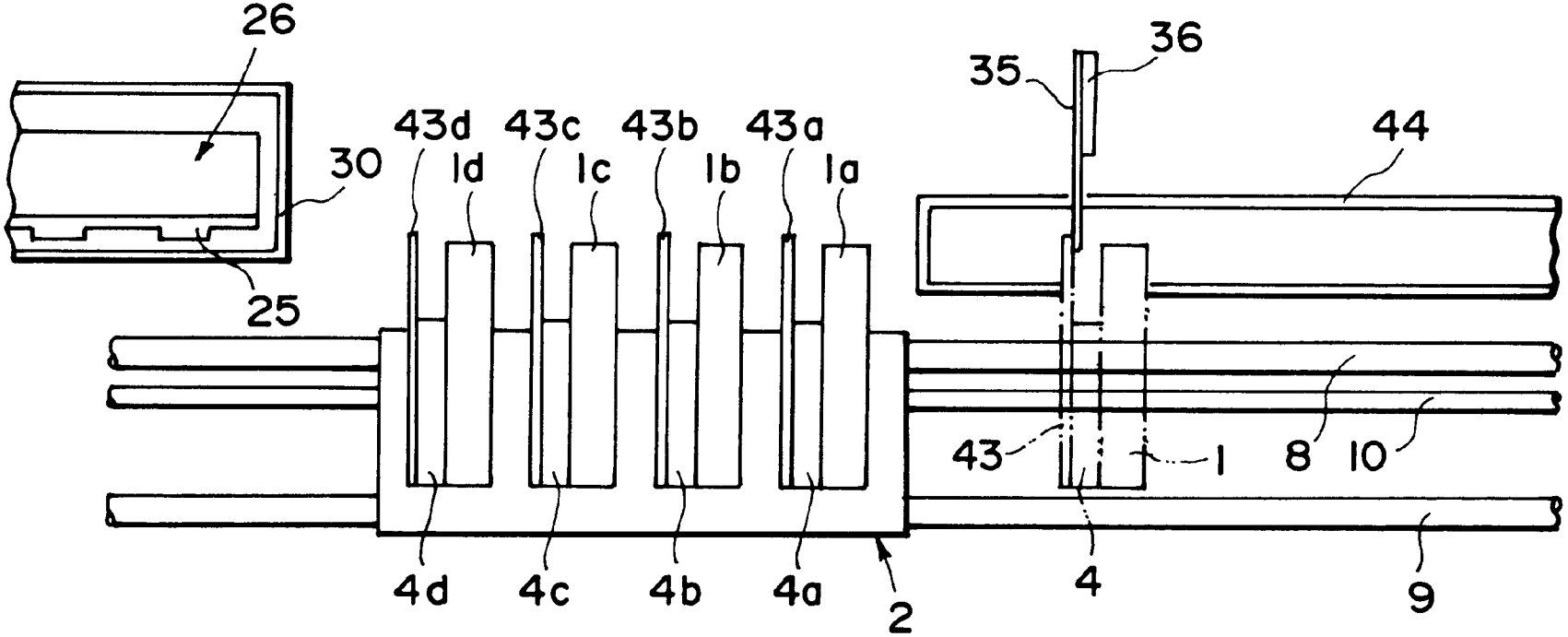
FIG. 6 is a partial plan view of a major part of an ink jet recording apparatus according to a second embodiment of the present invention.

Referring to FIG. 6, there is shown a major part of an ink jet recording apparatus according to a second embodiment of the present invention. In this embodiment, the projections (projected member) 43*a*, 43*b*, 43*c* and 43*d* which is relatively movable with respect to the wiping member (rubber blade) 35 while being in contact therewith, are integrally formed or mounted on the recording head (recording means) 1. When any one or all of the projections 43*a*, 43*b*, 43*c* and 43*d*, are designated, it or they are called simply projection 43. In FIG. 6, between the recording region and the cap 26, the wiping member (rubber blade) 35 is disposed, and fixed on a holder 36.

On the other hand, a carriage 2 reciprocable along guide rails 8 and 9, carries four recording heads 1*a*, 1*b*, 1*c* and 1*d* at predetermined intervals. The left side surfaces of these recording heads are provided with head temperature controlling heaters 4*a*, 4*b*, 4*c* and 4*d*. When any one or all of these heaters are designated, it or they are simply called heater 4. Each of the projections 43 is connected to the left side surfaces of the heaters 4 in the Figure. The heater 4 is fixed by being sandwiched between the recording head 1 and the projection 43, so that the heat can be transferred to both of them. The projection (projected member) 43 is of aluminum or another material having high thermal conductivity. It is so disposed that the end portion rubs the end portion of the wiping member 35 during movement of the carriage 2, as indicated by chain lines in FIG. 6.

Below the wiping member 35, a second residual ink container 44 is disposed. The second residual ink container 44 is so disposed as to cover the wiping member 35 region and a recording region of the recording head 1 (recording scan stroke range). The second embodiment shown in FIG. 6 is different from the first embodiment of FIGS. 1–5, in the above-described respects. In the other respects, they are substantially the same. More particularly, the recording mechanism, the recovery mechanism (for preventing clogging of the ejection outlets 82) comprising the cap 26 and the air pump 31 (FIG. 3), and the like, are substantially the same as in the case of the first embodiment.

In the operation of the apparatus of this embodiment, the recording head 1 and the projection 43, are controlled at a temperature of 180° C. approximately, for example by the respective heaters. Similarly to the first embodiment, the cap rubber 25 of the cap 26 is contacted to the ejection side surface 81 of the recording head 1 so as to hermetically seal the ejection outlets 82. Thereafter, the air pump 31 is operated for the sucking action. When the recording signal is produced, the cap 26 is retracted (separated), and the carriage 2 is moved into the recording region. During the movement, the wiping member (rubber blade) 35 first contacted to the ejection side surface 81 of the recording head 1*a* at the end portion of the blade 35, so that the cleaning operation (wiping operation) is carried out. Immediately thereafter, the end portion of the wiping member 35 is brought into contact with the end portion of the first projection (the projection of the first recording head 1*a*) 43*a*, so that the ink (cyan ink in this embodiment) which is going to be solidified on the wiping member 35 is wiped out while being maintained in the liquid state, by the projection 43*a*. The removed ink falls into the second residual ink container 44.

The ejection side surface 81 of the second recording head 1*b* is cleaned (wiped) by the wiping member 35. Immediately thereafter, the ink (magenta ink) which is going to be solidified on the wiping member 35 is removed by the second projection 43*b* while it is being liquefied. The removed ink falls into the second residual ink container 44. In the similar manner, the cleaning operation (wiping operation) for the third recording head 1, the wiping operation for the wiping member 35 by the third heated projection 43*c*, the cleaning for the fourth recording head 1*d*, and the cleaning of the wiping member 35 by the fourth heated projection 43*d*, are carried out.

The operations of the second embodiment shown in FIG. 6, other than the operations described above, are substantially the same as with the first embodiment. Therefore, the same advantageous effects has in the first embodiment, can be provided by the second embodiment. In addition, since the recording heads 1 and the projections 43 are heated by a common heater 4, and therefore, the number of temperature controlling circuits can be reduced as compared with the case of the first embodiment. With the structure of FIG. 6, there is no need of a mechanism (FIG. 3) rotating the wiping member 35, and therefore, the structure of the apparatus can be simplified, correspondingly.

Figure 7:
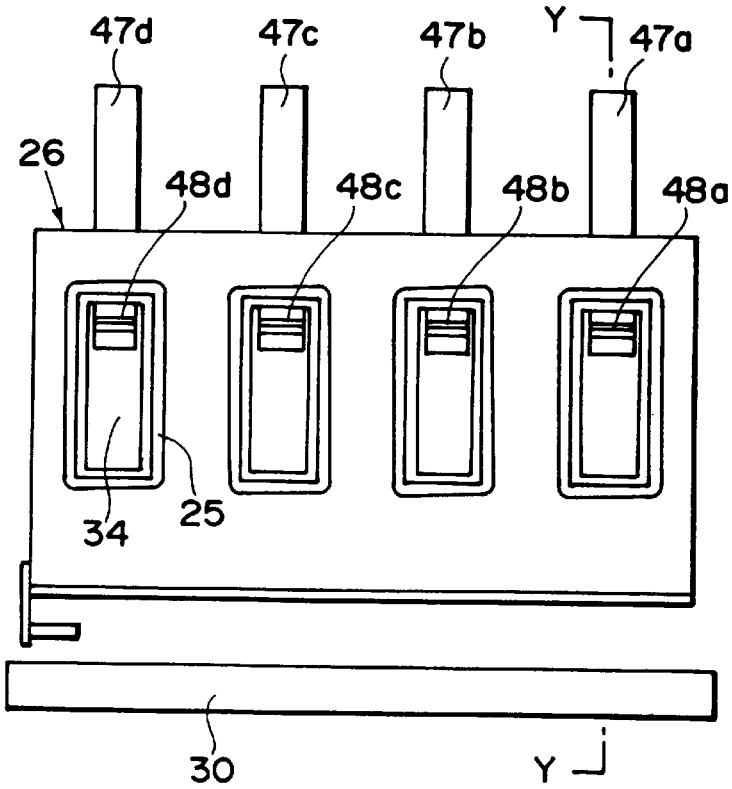
FIG. 7 is a partial front view of a cap of an ink jet recording apparatus according to a third embodiment of the present invention.
Figure 8:
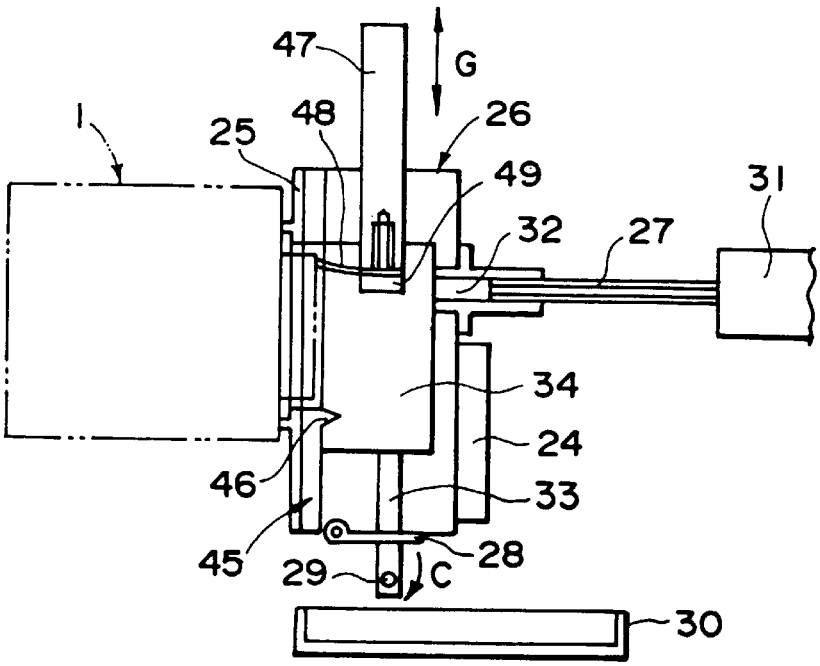
FIG. 8 is a sectional view taken along a line y—y in FIG. 7.

Referring to FIG. 7, there is shown an ink jet recording apparatus according to a third embodiment of the present invention (cap 26). FIG. 8 is a sectional view taken along a line Y—Y in FIG. 7. In this embodiment, the wiping member for cleaning the ejection side surface 81 and the projection for wiping and cleaning the wiping member, are on capping means (cap) 26. In FIGS. 7 and 8, there are four spaces 34 in the cap 26, corresponding to the four recording heads 1. The spaces 34 are in communication with air ports 32 and discharge ink ports 33.

In this embodiment, a cap plate 45 is mounted on a front side of the cap 26, and a capping rubber 25 for the hermetical sealing is mounted on the front side of the cap plate 45. The capping plate 45 and the capping rubber 25 are provided with openings for receiving ink ejecting part of the recording head 1 and for communication with the spaces 34. Below the opening of the cap plate 45, a projection 46 into the space 34 is formed. The cap plate 45 and the cap 26 are thermally connected, and they are temperature-controlled at approx. 80° C. by a cap temperature control heater 24.

At an upper portion of the cap 26, blade shafts 47*a*, 47*b*, 47*c* and 47*d* extending into the spaces 34, are mounted for vertical movement with the sealed state. When any one or all of the blade shafts are designated, it or they are called blade shaft 47. The blade shafts 47 is substantially vertically movable in a direction indicated by an arrow G by an unshown transmitting means such as a cam, simultaneously. To the end portions (the portions always in the spaces 34) of the four blade shafts 47, wiping members (rubber blades 48*a*, 48*b*, 48*c* and 48*d*) are mounted by screws 47. When any one or all of the wiping members, it or they are called simply wiping member 48.

When the wiping member 48 moves substantially in the vertical direction, the end portions thereof rubs the ejection side surface 81 which is in the cap state, so that they are cleaned, and in addition, the wiping members 48 are cleaned by the projections 46. The third embodiments shown in FIGS. 7 and 8, are different in these respects from the first embodiment shown in FIGS. 1–5, but they are substantially the same in the other respects, and therefore, the detailed descriptions thereof are omitted for simplicity by assigning the same reference numerals to the elements having the corresponding functions.

In operation of the apparatus of this embodiment, similarly to the first embodiment, the recording heads are heated to a predetermined temperature higher than the fusing point of the ink by the heater 4 (FIG. 3) or the like. The cap 26 and the cap plate 45 having the projections 46 are heated to approx. 80° C. by the cap temperature controlling heater 24. The caps 26 are contacted to the recording heads 1, and the sucking pump 31 is operated. With the capped state maintained, the blade shafts 47 are lowered from the position shown in FIGS. 7 and 8. During the lowering movement, the wiping members 48 clean or wipe the ejection side surfaces 82 of the recording head 1. After the cleaning operation, the end portions of the wiping member 48 are rubbed by the projections 46, so that the ink deposited on the wiping member 48 is removed. The removed ink, similarly to the first embodiment, falls in the first residual ink container 30 through the residual ink port 33.

Thereafter, the cap 26 is removed away from the ejection side surface 82, and the blade shaft 47 are raised to the original position indicated in the Figure. Thereafter, the carriage 2 is moved into the recording region to start the recording operation. The operations of the apparatus of this embodiment other than those described above, are substantially the same as in the first embodiment. Therefore, according to the embodiment of FIGS. 7 and 8, the same advantageous effects as in the first embodiment can be provided. In addition, since the wiping member 48 and the projections 46 are in the cap 26, both of the ink sucked out by the pump 31 and the ink wiped out by the wiping member 48, can be received by a single residual ink container 30, and therefore, the necessity for the second residual ink containers 42 and 44, is eliminated. Thus, the apparatus is simplified.

In the foregoing embodiments, the ink jet recording apparatus has been described as having a plurality of recording head 1 containing different color inks. However, the present invention is applicable to an ink jet recording apparatus having a single recording head, or to an ink jet recording apparatus for tone reproducing using a plurality of recording head having the same color but different densities, that is, the present invention is applicable irrespective of the number of recording heads or the number of inks.

In the foregoing embodiments, the ink jet recording apparatus is of a serial scanning type in which the recording head is carried on a carriage 2. However, the present invention is applicable to a line type ink jet recording apparatus in which a line type recording head having a length covering an entirety or a part of the width of the recording material is used, so that the recording operation is carried out by the sub-scan direction movement. In that case, the wiping member is heated, and the same advantageous effects can be provided. As for the recording head (recording means), it may be a cartridge type which is integral with an ink container, or a type in which the recording head is connectable with an ink container through an ink supply tube or the like. That is, the present invention is applicable with the same advantageous effect irrespective of the types of the recording heads.

An ink jet recording apparatus to which the present invention applicable may comprise a recording head using electromechanical converters such as piezoelectric elements. However, an ink jet recording apparatus ejecting the ink using thermal energy is most applicable. In this case, a high density and fine image can be produced.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the ink deposited on the surface of the wiping member can be easily and assuredly removed even when a solid ink fusable at a temperature higher than the room temperature is liquefied and then ejected. Therefore, the ejection side surface can be cleaned by always clean wiping member, and therefore, the improper ink ejection or ink ejection failure attributable to incomplete cleaning, can be avoided.

According to another aspect of the present invention, the projection is integral with the recording means, or the wiping member and the projection are mounted on capping means for hermetically sealing the ejection outlet of the recording means, by which the above advantageous effects can be further assured.

While the invention has been described with reference to the structures disclosed herein, it is not confined to the details set forth and this application is intended to cover such modifications or changes as may come within the purposes of the improvements or the scope of the following claims.

What is claimed is:

1. An ejection recovery mechanism for an ink jet apparatus effecting recording using a recording head having a heating device therein and a solid ink which is solid at a temperature below a room temperature and is liquid above a predetermined temperature higher than the room temperature, wherein the recording head is heated by the heating device and ink in the recording head is maintained in a liquid state, the ejection recovery mechanism comprising:

a first cleaning member slidable in contact with an ink discharging side surface of the recording head for discharging the liquefied ink to clean the ink discharging side surface;

a second cleaning member slidable in contact with said first cleaning member to remove solidified ink from said first cleaning member; and a temperature control means for controlling the temperature of said second cleaning member, wherein a temperature of said second cleaning member is controlled at a temperature above the room temperature so as to liquefy the solidified ink on said first cleaning member, and said first cleaning member is thermally independent from said second cleaning member except during contact between said first cleaning member and said second cleaning member.

2. A mechanism according to claim 1, wherein the temperature of said second cleaning member is controlled so that said temperature is higher than a melting point of said ink.

3. A mechanism according to claim 1, wherein said first cleaning member is disposed in a movement path of said recording head and wherein said first cleaning member is movable and is rubbed by said second cleaning member after said first cleaning member cleans said ink discharging side surface.

4. A mechanism according to claim 1, wherein said second cleaning member is disposed adjacent to said recording head and scans with said recording head along a scanning path between a recording region and a non-recording region, and said first cleaning member is disposed in the scanning path and is rubbed by said second cleaning member after said first cleaning member cleans said ink discharging side surface.

5. A mechanism according to claim 1, further comprising a capping member for capping said recording head, wherein said first cleaning member and said second cleaning member are provided at a portion of contact between said capping member and said recording head.

6. An ejection recovery mechanism for an ink jet apparatus effecting recording using a recording head having a heating device therein and a solid ink which is solid at a temperature below a room temperature and is liquid above a predetermined temperature higher than the room temperature, wherein the recording head is heated by the heating device and ink in the recording head is maintained in a liquid state, the ejection recovery mechanism comprising:

a first cleaning member slidable in contact with an ink discharging side surface of the recording head for discharging the liquefied ink to clean the ink discharging side surface;

a second cleaning member slidable in contact with said first cleaning member to remove solidified ink from said first cleaning member;

a temperature control means for controlling the temperature of said second cleaning member, wherein a temperature of said second cleaning member is controlled at a temperature above the room temperature so as to liquefy the solidified ink on said first cleaning member, and said first cleaning member is thermally independent from said second cleaning member except during contact between said first cleaning member and said second cleaning member; and movement control means for controlling movement of said first cleaning member or said second cleaning member.

7. A mechanism according to claim 6, wherein the temperature of said second cleaning member is controlled so that said temperature is higher than a melting point of said ink.

8. A mechanism according to claim 6, wherein said first cleaning member is in a movement path of said recording head, and wherein said first cleaning member is movable and is rubbed by said second cleaning member after said first cleaning member cleans said recording head.

9. A mechanism according to claim 6, wherein said second cleaning member is disposed adjacent to said recording head and scans with said recording head along a scanning path between a recording region and a non-recording region, and said first cleaning member is disposed in the scanning path and is rubbed by said second cleaning member after said first cleaning member cleans said ink discharging side surface.

10. A mechanism according to claim 6, further comprising a capping member for capping said recording head, wherein said first cleaning member and said second cleaning member are provided at a portion of contact between said capping member and said recording head.

11. An ejection recovery method for an ink jet apparatus effecting recording using a recording head having a heating device therein and a solid ink which is solid at a temperature below a room temperature and is liquid above a predetermined temperature higher than the room temperature, wherein the recording head is heated by the heating device and ink in the recording head is maintained in a liquid state, the method comprising the steps of:

cleaning an ink discharging side surface of the recording head for discharging the liquefied ink by wiping the surface by a first cleaning member;

removing solidified ink from the first cleaning member by wiping said first cleaning member with a second member;

controlling a temperature of said second cleaning member at a temperature above the room temperature so as to liquefy the solidified ink on said first cleaning member; removing said ink from the first cleaning member; and operating said first cleaning member thermally independent from said second cleaning member except during contact between said first cleaning member and said second cleaning member.

12. A method according to claim 11, wherein the temperature of said second cleaning member is controlled so that said temperature is higher than a melting point of said ink.

13. A method according to claim 11, wherein said first cleaning member is disposed in a movement path of said recording head, and wherein said first cleaning member is movable and is rubbed by said second cleaning member after said first cleaning member cleans said ink discharging side surface.

14. A method according to claim 11, wherein said second cleaning member is disposed adjacent to said recording head and scans with said recording head along a scanning path between a recording region and a non-recording region, and said first cleaning member is disposed in the scanning path and is rubbed by said second cleaning member after said first cleaning member cleans said ink discharging side surface.

15. A method according to claim 11, wherein there is provided a capping member for capping said recording head, and said first cleaning member and said second cleaning member are disposed at a contact portion between the capping member and the recording head.

* * * * *

UNITED STATES PATENT AND TRADEMARK OFFICE

CERTIFICATE OF CORRECTION

PATENT NO. : 5,914,735

DATED : June 22, 1999

INVENTOR(S) : KOSUKE YAMAMOTO et al.

It is certified that error appears in the above-identified patent and that said Letters Patent is hereby corrected as shown below:

COLUMN 5

Line 64, "hole" should read --all--.

COLUMN 6

Line 54, "temperature" should read --temperatures--.

Signed and Sealed this

Twenty-first Day of December, 1999

*Attest:*

Q. TODD DICKINSON

*Attesting Officer*

*Acting Commissioner of Patents and Trademarks*